United States Patent [19]

Wilson

[11] 4,323,231

[45] Apr. 6, 1982

[54] JUMPING BOARD

[75] Inventor: Robert M. Wilson, Vanceboro, N.C.

[73] Assignee: Jump for Joy Ltd., Vanceboro, N.C.

[21] Appl. No.: 205,005

[22] Filed: Nov. 7, 1980

[51] Int. Cl.[3] ..... A63B 5/18

[52] U.S. Cl. ..... 272/65; 272/70; 272/144

[58] Field of Search ..... 272/70, 65, 130, 135, 272/136, 137, 138, 141, 109, 93 R, 96, 100, 101, 66, 76, 116 R, 125, 126, 134, 144; 5/444, 474, 481, 448, 417; 273/1 A

[56] References Cited

U.S. PATENT DOCUMENTS

| | | | |
|---|---|---|---|
| 2,193,743 | 3/1940 | Sargent | 5/474 X |
| 2,853,399 | 9/1958 | Shoults | 5/417 X |
| 2,859,455 | 11/1958 | Koenigsberg | 5/474 X |
| 3,066,928 | 12/1962 | Lawrence et al. | 5/481 X |
| 3,205,515 | 9/1965 | Unger | 5/481 |
| 3,451,075 | 6/1969 | Woodward | 5/474 |
| 3,459,611 | 8/1969 | Joseph et al. | 272/109 X |
| 3,518,786 | 7/1970 | Holtvoigt | 5/481 X |
| 3,636,576 | 1/1972 | Nissen | 272/65 X |
| 4,080,675 | 3/1978 | Kanowsky et al. | 5/481 X |

FOREIGN PATENT DOCUMENTS

| | | | |
|---|---|---|---|
| 2037155 | 7/1980 | United Kingdom | 5/474 |

*Primary Examiner*—Richard C. Pinkham
*Assistant Examiner*—Arnold W. Kramer
*Attorney, Agent, or Firm*—Lerner, David, Littenberg & Samuel

[57] ABSTRACT

A jumping board which is particularly well-suited to provide a surface on which a person may jump rope. The board comprises a resiliently deformable member of foam material having a pair of oppositely disposed substantially planar surfaces and a peripheral edge surface joining the planar surfaces about the periphery of the deformable member. First and second planar sheet members are disposed in surface contact and adhered with the planar surfaces of the deformable member. The jumping board additionally includes a resiliently deformable peripheral edge member for the periphery of the deformable member. The edge member has first and second spaced end edge portions and an intermediate body portion. The first and second end edge portions are joined to the peripheral edges of the first and second planar sheet members, respectively, about the entire periphery of the deformable member, and the intermediate body portion is spaced from the peripheral edge surface of the deformable member to define a hollow area therebetween. The intermediate body portion is sufficiently rigid to prevent curling of the deformable member at the peripheral edge surface so as to maintain a substantially planar configuration for the board, yet is resiliently deformable so as to collapse and provide cushioning when a person jumps on the edge member of the jumping board. In this manner, a relatively uniform and smooth transition is provided between the jumping surface and the surface on which the jumping board is placed, thereby minimizing the possibility of injury to the person jumping on the jumping board.

25 Claims, 2 Drawing Figures

JUMPING BOARD

FIELD OF THE INVENTION

The present invention relates to athletic or gymnastic equipment, and more particularly to a jumping board which is particularly well-suited to provide a surface on which a person may jump rope.

BACKGROUND OF THE INVENTION

Recently, there has been a great emphasis placed on the need for exercise to improve one's health, both from the standpoint of weight reducing as well as from the standpoint of improving heart and lung efficiency. It is generally acknowledged and understood that in order to accomplish these goals, one must engage in a stressful type of exercise, such as for example, tennis, skiing, jogging, bicycling, squash, handball, etc. One leading form of stress-type exercise, but one which has not received much attention, is jumping rope. In fact, jumping rope can be from two to seven times more effective in producing physical fitness than most other forms of exercise, and can be accomplished in less time. For instance, by jumping rope one can expend calories at approximately twice the rate as playing racketball for the same period of time.

Despite the fact that jumping rope is a leading form of stress-type exercise, very few people have engaged in such exercise as part of a physical training or exercise program, probably for a number of reasons. One significant reason probably is the fact that most people do not know how to jump rope or know what is needed in order to accomplish the desired beneficial results. For example, in order to achieve the maximum benefit, and in particular to achieve physical fitness, it is necessary that one jump rope at least five hundred times per day without stopping. However, jumping rope at this rate on a hard surface, such as a hard floor or pavement, can often lead to injury, especially to the feet, ankles and knees. On the other hand, if one jumps rope on a soft cushioning surface (such as a carpet indoors or the lawn outdoors), in order to save wear on one's feet, ankles and knees, the person is likely to experience a "sinking" feeling. This destroys one's balance and rhythm, and affects coordination and endurance, thus preventing achievement of the beneficial effects of jumping rope.

While a number of athletic or gymnastic mats are known in the art, the purpose behind such mats is mainly to provide a spring and cushion during the finale of the action—i.e., the landing. That is, a tumbler, high-jumper, broadjumper or a gymnast or pole vaulter takes off from a firm footing, never one which provides any springing or cushioning, and only lands on the mat during the landing. Such surfaces thus are not particularly well-suited for continuous jumping since they are designed to only take up or absorb the shock of one fall or jump at a time and consequently, are often very springy or resilient. Furthermore, as is well known with such mats, the cushioning or resiliency effect is designed mainly to be within the center of the mat, and not at the edges. In fact, at the edge portions of such mats, there is usually a sharp transition between the hard or firm surface on which the mat is placed and the mat itself, both in terms of the cushioning effect as well as the physical characteristics. If one were to jump rope on such mats having such definite transition, the rope would most likely snag or catch on the edge if one were jumping at the edge of the mat, thus destroying the rhythm and balance of the person jumping. Still further, with very thick mats, there is a possibility of injury should one happen to step off the mat during the jumping exercise.

Accordingly, a need exists for a surface which is particularly well-suited for jumping rope, both in terms of providing cushioning or shock absorbing benefits during the rope jumping exercise so as to minimize the chances of injury or damage to one's feet, ankles, knees, as well as one which is firm so as not to destroy or adversely affect the rhythm, coordination and balance of the person.

SUMMARY OF THE INVENTION

In accordance with the present invention, there is provided a jumping board which overcomes the above noted and other disadvantages of the prior art and which provides a jumping surface which is particularly well-suited for jumping rope so as to enable one to achieve fully the beneficial results of jumping rope while at the same time minimizing the possibility of danger or injury or other distracting characteristics which might interfere with such exercise. More particularly, the jumping board in accordance with the present invention comprises a resiliently deformable member of foam material having first and second oppositely disposed planar surfaces and a peripheral edge surface joining the first and second planar surfaces about the entire periphery of the deformable member. First and second planar sheet members are disposed in surface contact with the first and second surfaces of the deformable member, and a resiliently deformable peripheral edge member having first and second spaced end edge portions and an intermediate body portion are provided. The first and second end edge portions are adhered to the peripheral edges of the first and second planar sheet members respectively about the entire periphery thereof, and the intermediate body portion is spaced from the peripheral edge surface of the deformable member to define a hollow area between the peripheral edge surface of the deformable member and the edge member. The intermediate body portion is sufficiently rigid to maintain a substantially planar configuration for the jumping board when a person jumps thereon and yet is resiliently deformable so as to collapse and provide cushioning when a person jumps on or adjacent the edge member.

In this manner, the jumping board will not curl at its periphery, but rather will remain substantially planar and flat which is most important in jumping rope. Additionally, the edge member provides a uniform transition between the board and the firm surface on which it is placed for the jumping rope exercise. Thus, the entire board may be utilized by a person while minimizing the possibility of injury or risk when one jumps along the peripheral edge of the jumping board since the edge member serves to cushion or absorb the shock during jumping and also eliminates any sharp drops or steps at the board edge.

In the preferred embodiment, the intermediate body portions has inner and outer surfaces with the outer wall surface being curved to provide a relatively smooth juncture or edge for the jumping board. Additionally, the distance between the inner and outer wall surfaces varies from a minimum at the end edge portions bonded to the planar sheet members to a maximum at the midpoint of the intermediate body portion. This is important in providing the desired rigidity to prevent curling of the mat and also in providing a uniform transition and shock absorbing effect between the main central portion of the board and the outer peripheral edge. That is, the foam material of the deformable member provides the main shock absorbing effect in the central portion of the board whereas the edge member, and its arrangement at the peripheral edge of the deformable material to define a hollow area, provides a similar type of cushioning effect at the peripheral edge of the board. This arrangement is most important in allowing the edge member to collapse or crush to thereby minimize the danger of turning of ankles, etc. should one be jumping along the edge of the mat. Further, by having a curved or rounded edge for the board, the rope will not catch or snag during the jumping rope exercise.

In the preferred embodiment, the foam material comprises polyethylene foam material, the planar sheet members comprise extruded polyethylene sheets, and the edge member comprises a molded polyethylene material. All of these components are sonically welded together in the desired structure. The extruded polyethylene sheets offer maximum resiliency and cushioning for the board when bonded to the foam material of the deformable member, as well as a long lasting surface having a smoothness which eliminates drag on the rope as it moves therealong during the jumping rope exercise.

These and further features and characteristics of the present invention will be apparent from the following detailed description in which reference is made to the enclosed drawings which illustrate a preferred embodiment of the present invention.

DETAILED DESCRIPTION OF THE PREFERRED EMBODIMENT

Figure 1:
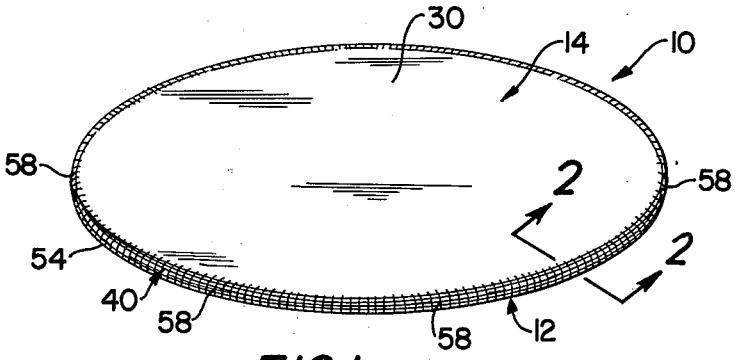
FIG. 1 is a perspective view of the jumping board in accordance with the present invention.

Referring now to the drawings wherein like reference characters represent like elements, there is shown in FIG. 1 a board 10 in accordance with the present invention which is particularly well-suited for providing a surface on which a person may jump rope. More particularly, the jumping board 10 is generally circular in shape and has a pair of oppositely disposed substantially planar or flat surfaces 12, 14. One of the flat surfaces 12 is adapted to rest on a suitable support surface such as a floor or pavement, and the other surface 14 faces upwardly and provides a surface on which a person may jump.

The jumping board 10 is designed to provide shock absorption or cushioning benefits when a person jumps on the upwardly facing surface, thereby minimizing the possibility of injury or damage to one's feet, ankles, shins, knees, etc. At the same time, however, the jumping board 10 is designed so as not to be too soft or cushiony, as otherwise a jumper might "sink" too deeply into the board on each jump, thereby creating difficulties in accomplishing rhythm and balance during a jumping rope exercise. It should be noted in this regard that by jumping rope one not only produces physical fitness, but, if done properly, also result in greater balance, rhythm, concentration, coordination and endurance.

Advantageously, the jumping board 10 is between approximately three and four feet in diameter and preferably approximately four feet in diameter which is adequate for pleasurable and effective jumping, yet is small enough for indoor jumping and presents minimum problems in transporting or carrying the board. The overall thickness of the jumping board 10 preferably ranges between ½ inch to 1½ inches, with the optimum thickness being approximately one inch. This thickness is advantageous in minimizing the danger of injury to a jumper if he should happen to step off the jumping board while jumping rope yet still provides adequate shock absorption or cushioning.

Figure 2:
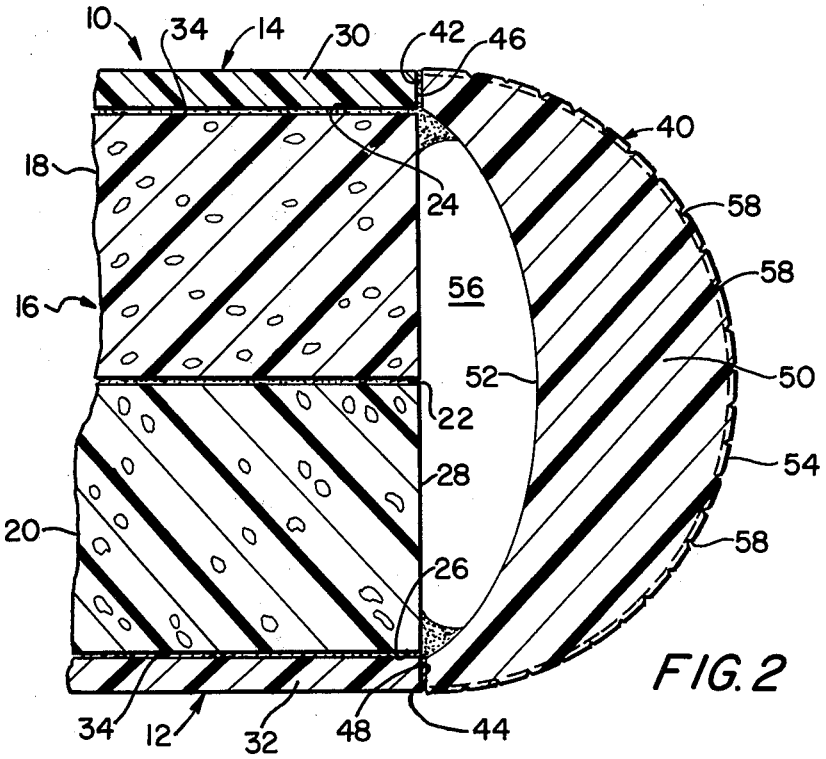
FIG. 2 is a sectional view taken along lines 2—2 of FIG. 1 illustrating a portion of the inner foam material and outer sheet members to which is bonded the resiliently deformable edge member in accordance with the present invention.

As more clearly shown in FIG. 2, the jumping board in accordance with the present invention comprises an inner, resiliently deformable member 16 made of foam material for providing the desired resilient cushioning or shock absorbing benefits over a major portion of the jumping board. In the preferred embodiment, the inner deformable member 16 is comprised of two generally cylindrical or disc-shaped foam bats 18, 20, each approximately one-half inch in thickness and approximately four feet in diameter. Each of the cylindrical bats 18, 20 is made of a polyethylene foam, such as for example polyethylene foam sold under the trademark "ETHAFOAM". The pair of disc-shaped foam bats 18, 20 are adhesively secured together, such as by means of contact cement 22, to provide an approximately one inch thick foam disc-shaped resiliently deformable member 16. The disc-shaped member 16 has upper and lower substantially planar surfaces 24, 26 and a peripheral edge surface 28 which serves to connect the upper and lower planar surfaces 24, 26 about the entire periphery of the disc-shaped foam member 16.

The upper and lower surfaces 24, 26 of the disc-shaped foam member 16 each have adhered thereto a planar sheet member 30, 32, the outer surfaces of which provide the upper and lower surface 14, 12 for the finished overall board 10. Preferably, the sheet members 30, 32 are each coextensive with the disc-shaped foam member 16 and are each approximately 40-60 mils in thickness. In the preferred embodiment, the sheets 30, 32 each comprise extruded polyethylene sheets which are 50 mils in thickness. The extruded polyethylene sheets 30, 32 are adhesively secured to the upper and lower surfaces 24, 26 of the disc-shaped foam member 16 by means of contact cement or any suitable adhesive 34 to ensure a good firm adhesive contact.

Lastly, the jumping board 10 has a peripheral edge member 40 secured to the outer peripheral edge of the composite structure section comprised of the disc-shaped foam member 16 and the upper and lower adhesively secured sheet members 30, 32. The edge member 40 preferably comprises a molded polyethylene member having upper and lower end edge portions 42, 44 which are bonded to the peripheral edge portions 46, 48 of the upper and lower sheet members, 30, 32, respectively, as can best be seen in FIG. 2. In this regard, in the preferred embodiment such bonding is accomplished by means of a sonic weld-type bond which also serves to bond portions of the inner wall of the edge member 40 to portions of the disc-shaped foam member 16 to provide a substantially integral structure. It of course will be appreciated that although separate foam discs 18, 20, sheet members 30, 32 and an edge member 40 are shown which are then assembled and integrally joined together, some of these components could also be joined together or integrally formed together as one piece before being finally assembled. For instance, the edge member 40 could be integrally formed with one of the sheet members 30, 32, in which event the disc-shaped foam member 16 would be placed thereinto and a second sheet member secured in place.

Intermediate the two end edge portions 42, 44, the edge member has an intermediate body portion 50 defined by inner and outer wall surfaces 52, 54. The inner wall surface 52, when the edge member 40 is secured in place, is spaced from the peripheral edge surface 28 of the disk-shaped foam member 16 in order to define a hollow area 56 which extends around the entire periphery of the jumping board 10. The outer wall surface 54 of the edge member 40 is preferably smoothly rounded or curved to provide a smooth, finished outer edge for the jumping board 10.

The spacing between the inner and outer wall surfaces 52, 54, i.e., the thickness of the edge member 40, varies between the upper end edge portion 42 and the lower end edge portion 44. More particularly, in the preferred embodiment, the spacing between the inner and outer wall surfaces 52, 54 varies from a minimum distance or thickness at the upper end edge portion 42 to a maximum distance or thickness at approximately the midpoint of the intermediate body portion 50 and then decreases to a minimum distance or thickness at the lower end edge portion 44. At the midpoint, the spacing between the inner and outer wall surfaces 52, 54 (i.e., the thickness of the edge member 40) is preferably between $\frac{1}{4}$ to $\frac{1}{2}$ inch, and more preferably approximately $\frac{3}{8}$ inch. The spacing between the inner wall surface 52 and the peripheral edge 28 of the disc-shaped foam member 16 preferably varies between 0 and $\frac{1}{2}$ inch along the intermediate body portion 50. The outer wall surface 54 is preferably approximately $\frac{1}{2}$ to 1 inch from the peripheral edge of the disc-shaped foam member 16 at the midpoint of the intermediate body portion 50. In the preferred embodiment, as seen in FIG. 2, the jumping board 10 is approximately one inch thick and the outer surface 54 at the midpoint is approximately $\frac{1}{2}$ inch from the disc-shaped foam member 16 and is semicircular in cross section so as to smoothly conform and blend into the upper and lower surfaces of the sheet members 30, 32.

This configuration for the edge member 40 and its arrangement with respect to the disc-shaped foam member 16 serves to rigidify or strengthen the jumping board 10 so as to maintain a substantially planar, flat configuration for the jumping board 10 and in particular to prevent curling of the disc-shaped foam member 16 and/or the upper and lower sheet members 30, 32 at the peripheral edges, even when a person is jumping thereon. This rigidity is further enhanced by the increased thickness at the midsection of the intermediate body portion 50 between the upper and lower end edge portions 42, 44. Specifically, because of the thickened wall at the approximate midsection of the intermediate body portion 50, the board 10 is not bendable in half, and in fact, does not even curl at its edges, despite the fact that extremely flexible and deformable materials are utilized in its construction. As can be appreciated, this stiffening which serves to maintain a substantially planar or flat surface 14 on which a person may jump rope, is most desirable and advantageous to provide for maximum efficiency in jumping rope exercises. Specifically, as opposed to mats for jogging or tumbling, where the edge is not important, either for the cushioning effect or for the exercise activity being performed, when one is jumping rope the edge of the board 10 is most important. For example, because a rope is involved in jumping rope, it presents an additional element which must be taken into account. Curling of the edge of the board 10 might result in the rope being caught or snagged, thereby destroying the rhythm of the jumper. Also, in various jumping exercises, the jumper may want to jump along the edge member 40 of the board 10.

At the same time, the edge member 40 is still sufficiently flexible or resilient so that it will collapse or flatten when a person stands on the edge or jumps on the edge of the board 10. It should be noted in this regard that in essence the edge member 40 bends about the thinner wall sections more closely adjacent the end edge portions 42, 44 of the edge member 40 when one stands or jumps on the edge. Also, as a result of this flexibility and resiliency, and of the arrangement of the edge member 40 to provide a hollow area 56, the edge member 40 will serve to provide a cushion or shock absorbing effect when jumped on by a person.

These features are most important since no sharp or stepped transition is provided when a person jumps along or adjacent the edge of the board 10, such as for example when the person progressively jumps about the circumference of the board. Rather, a substantially uniform resilient or cushioning resistance is provided by the entire board 10, including the edge thereof. Furthermore, the feature of collapsability of the edge member 40 serves to minimize the risk of turning or twisting an ankle by a person jumping rope since no stepped edge will exist when a person stands or jumps on the edge of the board 10; rather, there is effectively a smooth transition from the central portion of the board 10 to the surface on which the board 10 rests.

It will also be noted from FIGS. 1 and 2 that the outer wall surface 54 of the edge member 40 is of a generally rounded configuration and is provided with grooves and serrations 58 thereon. This is advantageous as it allows for easier grasping and lifting of the board. Additionally, the rounded edge is most important since a rope will not catch on the edge member 40 during the jumping rope exercise, but rather, will simply glide across the board 10.

Thus, the jumping board 10 in accordance with the present invention is substantially rigid yet provides a shock absorbing cushioning effect when one jumps thereon. In this regard, it is preferable that the board 10 be at least one-half inch in thickness as, with a thinner board, a heavier type jumper might tend to overpower the intended resistant nature of the jumping board 10 and bottom-out on the surface on which the board 10 rests, thereby not achieving the maximum cushioning effects of the board 10. On the other hand, it is preferable that the thickness of the board 10 not exceed $1\frac{1}{2}$ inches as any thicker structure might cause a jumper to "sink" in the board 10. This "sinking" would present difficulties in accomplishing rhythm, balance, etc., and also might create problems in lifting one's feet from the surface 14 of the board 10 so as to allow the rope to pass therebeneath during the jumping exercise.

Another advantageous feature of the jumping board 10 in accordance with the preferred embodiment is the fact that with polyethylene extruded sheets 30, 32, it is possible to create a sound by the rope during the jumping exercise. This sound allows a jumper to sense rhythm and is an important key in successful rope jumping exercising. Still further, the polyethylene extruded sheets 30, 32 wear very well and may even be painted, such as for example to paint symbols or designs on the board 10 which may be used by the jumper for various jumping exercises. Also, with extruded polyethylene sheets, the outer flat surfaces 12, 14 of the board be sufficiently smooth so as not to wear out the rope, yet is not so smooth as to cause slippage by the person jumping rope thereon.

Because of the rigid nature of the board 10 in accordance with the present invention, the board 10 may be easily transported by simply rolling the board 10 along the edge member 40, much in the fashion that a tire is rolled by children down the street. At the same time, because polyethylene material is utilized in the preferred embodiment, the board 10 is extremely lightweight and may be easily lifted and transported by men, women and even children.

Thus, in accordance with the present invention there is provided a unique jumping board 10 which is particularly well-suited for jumping rope thereon, and which thus offers a vehicle by which men, women and children alike can achieve the benefits of exercise by jumping rope. The board 10 provides shock absorption or cushioning comfort to the feet, legs, and joints of the person jumping rope in order that such persons can jump on the order of at least 500 jumps per any given period without stopping, which is what is required for bringing about total physical fitness. When no mat or board at all is used, the feet, legs, ankles, and knees of a person jumping rope may become damaged or injured after only jumping of 100–200 jumps per any given period on a daily basis.

Additionally, with the board 10 of the present invention, it is possible to utilize the board 10 for creating games or series of exercises which may be displayed or represented on the board 10. This is most important in maintaining the interest of the person jumping rope. For instance, with the jumping board of the present invention, one may jump rope on the planar central section of the board 10, as well as along the edge member 40 since the edge member 40 also serves to provide a cushioning effect. Further, persons may progressively jump about the circumference of the board 10 since the edge member 40 does not present any sharp edges or transitions at the edge of the board 10. At the same time, the edge will not curl during the rope jumping exercise which might present a problem in catching of the rope and thus destroy the rhythm of the rope jumper.

Accordingly, there is provided in accordance with the present invention a jumping board 10 which comprises a resiliently deformable member 16 of foam material having first and second oppositely disposed planar surfaces 24, 26 and a peripheral edge surface 28 joining the first and second surfaces 24, 26 about the periphery of the deformable member 16. First and second planar sheet members 30, 32 are disposed in surface contact with the first and second surfaces 24, 26 of the deformable member 16, and a resiliently deformable peripheral edge member 40 is provided to finish the edge of the jumping board 10. The deformable edge member 40 includes first and second end edge portions 42, 44 and an intermediate body portion 50. The first and second end edge portions 42, 44 are each secured to the peripheral edges 46, 48 of the first and second planar sheet members 30, 32, respectively, about the entire periphery of the deformable member 16, and the intermediate body portion 50 is spaced from the peripheral edge surface 28 of the deformable member 16 to define a hollow area 56 between the peripheral edge surface 28 and the edge member 40. The intermediate body portion 50 is sufficiently rigid to maintain a substantially planar configuration of the board 10, even when one is jumping thereon, yet is resiliently deformable to collapse and provide cushioning when a person jumps on the edge member 40.

While the preferred embodiment of the present invention has been shown and described, it will be understood that such is merely illustrative and that changes may be made without departing from the scope of the invention as claimed.

What is claimed is:

1. A jumping board comprising:

a resiliently deformable member of foam material having first and second oppositely disposed planar surfaces and a peripheral edge surface joining said first and second surfaces about the periphery of said deformable member;

first and second planar sheet members disposed in surface contact with and secured to said first and second surfaces of said deformable member, said first and second planar sheet members each having peripheral edge portions;

a resiliently deformable peripheral edge member for the periphery of said deformable member, said peripheral edge member having first and second spaced end edge portions and an intermediate body portion intermediate said first and second end edge portions, said first and second end edge portions being joined to said peripheral edge portions of said first and second planar sheet members, respectively, about the entire periphery thereof, and said intermediate body portion being spaced from said peripheral edge surface of said deformable member to define a hollow area between said peripheral edge surface of said deformable member and said edge member about the periphery of said deformable member, said intermediate body portion being sufficiently rigid to maintain a substantially planar configuration for said jumping board when a person jumps thereon and being resiliently deformable to collapse and provide cushioning when a person jumps on said edge member of said jumping board.

2. The jumping board of claim 1 wherein said intermediate body portion includes an inner wall surface facing said peripheral edge surface of said deformable member and an outer wall surface facing away from said inner wall surface, and wherein the spacing between said inner and outer wall surfaces varies along said intermediate body portion between said first and second end edge portions of said edge member.

3. The jumping board of claim 2 wherein the spacing between said inner and outer surfaces is greatest at the midpoint along said intermediate body portion between said first and second end edge portions.

4. The jumping board of claim 3 wherein the spacing at said midpoint is between $\frac{1}{4}$ and $\frac{1}{2}$ inch.

5. The jumping board of claim 2 wherein said first and second planar sheet members are of first and second predetermined thicknesses respectively at said peripheral edge portions thereof; wherein the spacing between said inner wall surface and said outer wall surface adjacent said first end edge portion of said edge member corresponds to said first predetermined thickness of said first planar sheet member; and wherein the spacing between said inner wall surface and outer wall surface adjacent said second end edge portion corresponds to said second predetermined thickness of said second planar sheet member.

6. The jumping board of claim 5 wherein said first and second predetermined thicknesses are each less than the spacing between said inner and outer wall surfaces at the midpoint along said intermediate body portion between said first and second end edge portions.

7. The jumping board of claim 6 wherein said first and second predetermined thicknesses are between 40 mils and 60 mils.

8. The jumping board of claim 7 wherein said first and second predetermined thicknesses are equal.

9. The jumping board of claim 2 wherein the spacing between said inner and outer wall surfaces progressively increases along said intermediate body portion from said first end edge portion toward the midpoint of said intermediate body portion, and progressively decreases from the midpoint of said intermediate body portion toward said second end edge portion.

10. The jumping board of claim 9 wherein the distance from said peripheral edge surface to said outer wall surface of said edge member is equal to or less than one inch.

11. The jumping board of claim 9 wherein the spacing between said peripheral edge surface and said inner wall surface is between 0 and ½ inch along said inner wall surface between said first and second edge portions.

12. The jumping board of claim 9 wherein the spacing between said inner and outer wall surfaces along said intermediate body portion at said midpoint is between ¼ and ½ inch.

13. The jumping board of claim 2 wherein said outer wall surface is smoothly curved between said first end edge portion and said second end edge portion.

14. The jumping board of claim 13 wherein said outer wall surface is semicircular in cross section.

15. The jumping board of claim 1 wherein said foam material comprises polyethylene foam material.

16. The jumping board of claim 15 wherein said first and second planar sheet members comprise polyethylene extruded sheet members.

17. The jumping board of claim 16 wherein said polyethylene extruded sheet members are adhesively secured to said first and second oppositely disposed planar surface of said deformable member.

18. The jumping board of claim 16 wherein said resiliently deformable edge member is made of polyethylene material.

19. The jumping board of claim 18 wherein said polyethylene edge member is sonically welded to said first and second planar sheet members and to a portion of said peripheral edge surface of said deformable material.

20. The jumping board of claim 1 wherein said first and second planar sheet members comprise polyethylene extruded sheet members.

21. The jumping board of claim 20 wherein said resiliently deformable edge member is made of polyethylene material.

22. The jumping board of claim 1 wherein said resiliently deformable edge member is made of polyethylene material.

23. The jumping board of claim 1 wherein said deformable member is cylindrical in shape.

24. The jumping board of claim 23 wherein said cylindrically shaped deformable member has a diameter between three feet and five feet.

25. The jumping board of claim 24 wherein the thickness of said cylindrically shaped deformable member is between ½ inch and 1½ inches.

* * * * *